United States Patent [19]

Malone

[11] 4,177,387

[45] Dec. 4, 1979

[54] METHOD AND APPARATUS FOR CONTROLLED-TEMPERATURE VALVE MODE TRANSFERS IN A STEAM TURBINE

[75] Inventor: Paul E. Malone, Schenectady, N.Y.

[73] Assignee: General Electric Company, Schenectady, N.Y.

[21] Appl. No.: 867,572

[22] Filed: Jan. 6, 1978

[51] Int. Cl.[2] ..... H02P 9/04

[52] U.S. Cl. ..... 290/40 R; 60/660

[58] Field of Search ..... 290/40 R, 43, 51, 52, 290/54; 60/660–667; 415/47, 48, 49, 15

[56] References Cited

U.S. PATENT DOCUMENTS

| | | | |
|---|---|---|---|
| 3,403,892 | 10/1968 | Eggenberger et al. | 253/59 |
| 3,637,319 | 1/1972 | Stratton et al. | 415/1 |
| 3,740,588 | 6/1973 | Stratton et al. | 307/260 |
| 3,956,897 | 5/1976 | Zitelli et al. | 60/660 |
| 3,981,608 | 9/1976 | Sato et al. | 415/15 |
| 4,056,331 | 11/1977 | Sato | 415/15 |

OTHER PUBLICATIONS

1970 Thesis, "Admission Control of Steam Turbines", by R. J. Dickenson.

*Primary Examiner*—Gene Z. Rubinson
*Assistant Examiner*—Morris Ginsburg
*Attorney, Agent, or Firm*—Ormand R. Austin; John F. Ahern; James W. Mitchell

[57] ABSTRACT

An electrohydraulic control system and method are disclosed for operating valves controlling the admission of steam to a steam turbine. The system includes a mode transfer unit for effecting a transfer between a full arc mode of valve operation to a partial arc mode of operation such that the temperature of the steam turbine varies in a controlled manner, thus permitting control of turbine stresses. Apparatus is described for generating mode flow signals, combining the signals using time ratio switching such that during a mode transfer the signals vary linearly with an admission reference factor characteristic of each mode, and generating valve lift signals from a combined flow signal using multi-slope, piecewise linear approximations to the flow-lift characteristics of the full arc mode of valve operation. The system permits mode transfers wherein total steam flow is held substantially constant and first stage turbine temperature is caused to vary linearly with admission reference factor.

6 Claims, 6 Drawing Figures

METHOD AND APPARATUS FOR CONTROLLED-TEMPERATURE VALVE MODE TRANSFERS IN A STEAM TURBINE

BACKGROUND OF THE INVENTION

This invention relates to electrohydraulic control systems for positioning valves admitting steam to a steam turbine and more particularly to controlled-temperature transfers between full arc and partial arc modes of valve operation in a steam turbine.

The principles of operating steam turbines in the full arc mode and the partial arc mode are well known. A typical steam turbine in a turbine-generator unit of an electric power plant includes a number of steam admission arcs spaced about the circumference of the turbine casing and a number of control valves through which steam flows into the arcs and then into the turbine. When changes in load or flow are accommodated by simultaneously opening or closing all control valves, the turbine is said to be operating in the full arc mode. (In some turbines full arc mode operation involves setting all control valves wide open, then accommodating load changes by opening and closing a stop valve upstream of, and in series with, the control valves.) When, on the other hand, the control valves are opened or closed in a prescribed sequence to accommodate changes in turbine load or flow, thus admitting steam at different flow rates to different portions of the turbine circumference, the turbine is operating in the partial arc mode. Generally, operation in the partial arc mode is desirable at certain steady partial load conditions since lower throttling losses and better heat rates can be achieved than with full arc operation, while full arc operation is preferred during startup of the turbine since it permits temperature increases of the turbine inlet and first stage to occur move evenly about the turbine circumference, thus yielding lower stresses than would result from partial arc operation. The full arc mode may also be useful as an intermediate operating condition during a scheduled large load increase between two steady partial arc operating modes to limit the stresses of components such as the turbine rotor or casings or to permit increased loading rates.

A number of prior art valve control systems describe means to transfer between modes to utilize the respective advantages of the full arc and partial arc modes, and some known systems disclose features to avoid thermal shocks or the need for load level adjustments during transfer such as by attempting to keep the total steam flow rate constant during transfer. For example, U.S. Pat. No. 3,981,608 to Sato et al discloses an electrohydraulic control system wherein constant flow rate full arc-to-partial arc transfers are achieved by closing a first valve to its partial arc position while biasing the remaining valves open at a rate to maintain a constant total flow, then holding the first valve position constant while repeating the technique with successive valves until all valves are in their partial arc positions. U.S. Pat. No. 3,403,892 to Eggenberger et al, assigned to the assignee of the present invention and whose disclosure is incorporated herein by reference thereto, describes an electrohydraulic system for controlling steam valves which effects a mode transfer while attempting to maintain substantially constant turbine steam flow by simultaneously adjusting the gains and biases of electrohydraulic amplifiers which position the valves. U.S. Pat. Nos. 3,637,319 and 3,740,588 to Stratton et al, both assigned to the present assignee and whose disclosures are also incorporated herein by reference thereto, describe respectively a method and apparatus wherein a pulse generator or time ratio switching circuit is used instead of the potentiometers of U.S. Pat. No. 3,403,892 to vary amplifier biases and gains to achieve a smooth mode transfer. And U.S. Pat. No. 3,956,897 to Zitelli et al discloses a digital transfer control system wherein gradual mode transfers are effected by applying frequency-modulated pulses to a valve control mechanism.

The foregoing systems may help avoid thermal shocks to certain steam turbine components by permitting valve mode transfers to occur gradually, and may, by maintaining steam flow approximately constant during a mode transfer, limit the total temperature change associated with a transfer. However, none of the above-cited patents suggest means for controlling the rate of change of turbine temperature during a mode transfer, which would permit better management of turbine stresses and also allow combined or coordinated loading changes and mode transfers, and hence faster turbine startups and shutdowns at desirably low stresses.

Although it has been suggested in a thesis submitted to Polytechnic Institute of Brooklyn in 1970 ("Admission Control of Steam Turbines" by Mr. R. J. Dickenson) that steam flow could be held constant and first stage turbine temperature caused to vary linearly during a mode transfer, the system proposed therein to accomplish this transfer is complex and impractical with analog circuitry because of the many non-linear correction functions required.

Accordingly, it is a general object of the invention to provide a steam turbine electrohydraulic control system which permits controlled-temperature transfers between two modes of valve operation.

It is another object of the invention to provide an improved, simple electrohydraulic control system for effecting a transfer between the full arc and partial arc modes of valve operation such that total steam flow remains substantially constant and first stage turbine casing temperature varies substantially linearly with an admission reference factor indicative of the valve mode.

It is a further object of the invention to provide a method of transferring between two modes of operation of steam turbine valves whereby total steam flow is held substantially constant and first stage turbine temperature varies substantially linearly with admission reference factor.

SUMMARY OF THE INVENTION

The invention provides an electrohydraulic control system and method for transferring operation of the control valves of a steam turbine from a full arc mode to a partial arc mode such that during a transfer steam flow remains substantially constant and the temperature of the first stage of the turbine varies substantially linearly with an admission reference factor characterizing each mode. In a preferred embodiment, the system is directed toward control of turbine temperatures and stresses and includes mode flow signal generators to produce a full arc signal, a reversing signal, and a partial arc signal; a time ratio circuit for generating a multiplier in response to an admission reference factor; and control valve positioning units each including a signal conditioner to provide a combined flow signal which varies linearly with admission reference factor and a lift signal generator to provide valve lift signals for both full arc and partial arc modes from a single piecewise linear approximation to the full arc flow-lift characteristic.

BRIEF DESCRIPTION OF THE DRAWINGS

While the specification concludes with claims particularly pointing out and distinctly claiming the subject matter regarded as the invention, the invention will be better understood from the following description taken in connection with the accompanying drawings in which:

DETAILED DESCRIPTION OF THE INVENTION

In a preferred embodiment of the invention, the improved steam turbine electrohydraulic control (EHC) system permits control of turbine temperatures, and hence stresses, at all times during a mode transfer such as a transfer from a full arc to a partial arc mode of operation at a particular total steam flow. The system includes an admission reference unit for generating an admission reference factor whose values each characterize a full arc, partial arc, or an intermediate mode, and also for progressively varying the admission reference factor during a transfer. A time ratio circuit is also provided to generate, in response to an admission reference factor, a multiplier which is used to condition a set of flow signals for each of the steam turbine control valves. The flow signals to be conditioned by the multiplier are produced by flow signal generators of the EHC system which respond to a flow reference signal indicative of desired total steam flow and generate a set of partial arc, full arc and reversing (negative full arc) flow signals. A flow signal conditioner applies the multiplier to the partial arc and reversing flow signals and combines the result with the full arc flow signal to produce a combined flow signal for each valve which varies linearly with admission reference factor from a full arc value to a partial arc value as the transfer is effected. As a result, during the transfer total steam flow is held constant, turbine first stage temperature varies substantially linearly with admission reference factor, and turbine stress levels are closely controlled.

Figure 1:
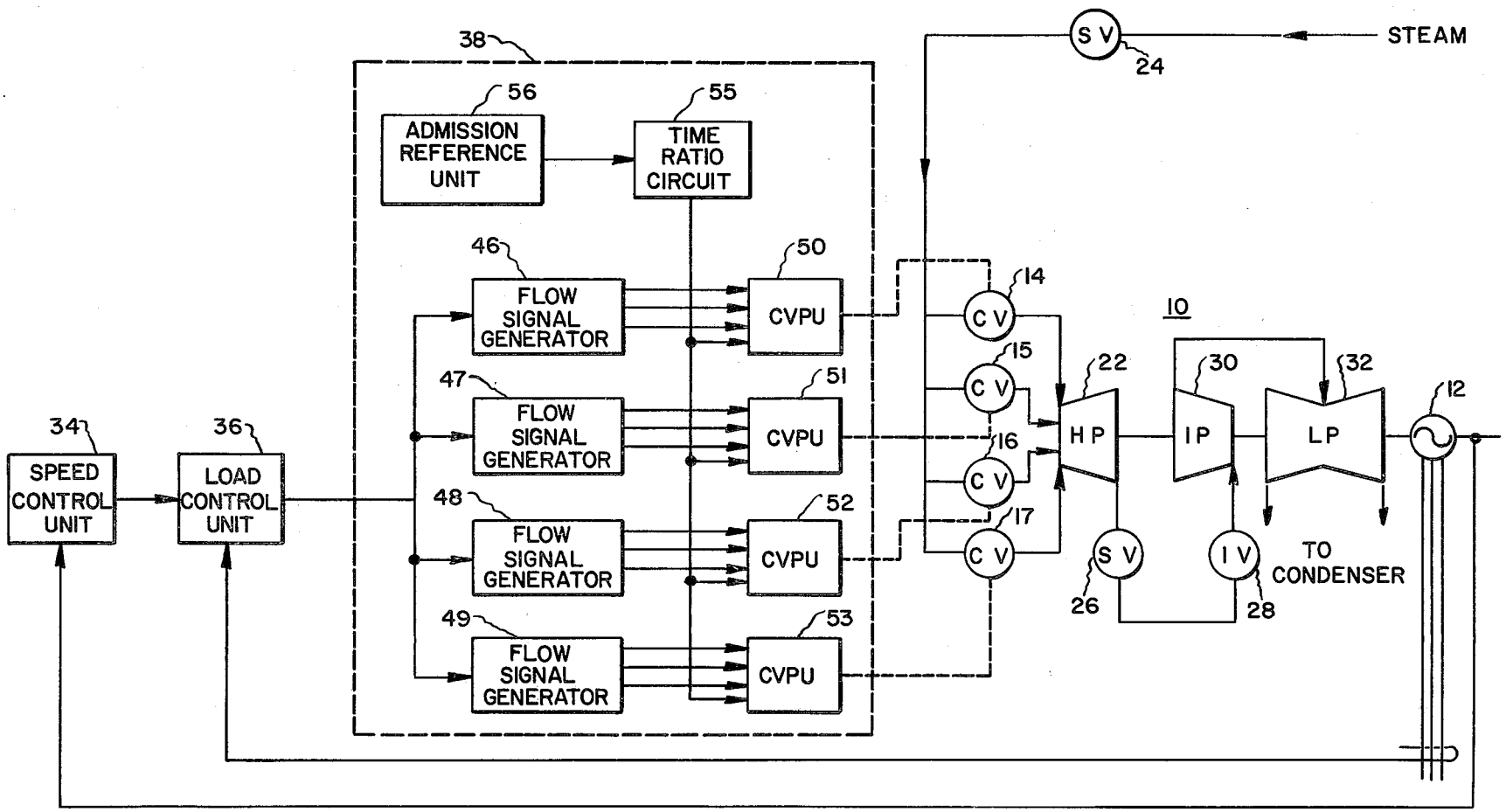
FIG. 1 is a simplified diagram of a steam turbine-generator unit and its electrohydraulic control system.

FIG. 1 shows a simplified diagram of a typical steam turbine 10 connected in driving relationship with a load such as generator 12, and a preferred embodiment of the electrohydraulic control system 13 of the present invention. The steam turbine 10, shown by way of illustration as a tandem reheat unit but whose form is not material to the invention, is controlled primarily by the admission of steam through a plurality of control valves such as valves 14, 15, 16, and 17 which are arranged in parallel to supply steam to the high-pressure turbine 22 through separate admission arcs (not shown) arranged about the circumference of the inlet of high-pressure turbine 22. Other valves shown in FIG. 1 include at least one stop valve 24 which in certain systems may be used to control stream flow during the full arc mode of operation, and at least one reheat stop valve 26 and intercept valve 28 used to control steam flow to the intermediate pressure and low-pressure turbines 30 and 32. Stop valves 24 and 26 and intercept valve 28 are not part of the present invention, and thus their positioning units and connections to other portions of the control system have been omitted in the interest of clarity.

As discussed above, the control valves 14, 15, 16, and 17 furnish steam to the turbine by operating in either a full arc mode wherein all control valves are opened or closed simultaneously to accommodate changes in load, or a partial arc mode wherein each valve opens and closes in a predetermined sequence. Operation of the control valves is determined by control system 13 which includes, in addition to valves 14, 15, 16 and 17, a speed control unit 34, load control unit 36, and mode transfer unit 38. Speed control unit 34 and load control unit 36 determine, in a manner known to the art, quantities such as actual speed, actual load, and rates of change of speed and load of the turbine and by processing these parameters in conjunction with desired reference values, calculate signals such as a flow reference signal indicative of desired steam flow and which in a preferred embodiment of the present invention is an input to mode transfer unit 38. Mode transfer unit 38, an essential part of the invention, processes the flow reference signal from load control unit 36 and furnishes lift signals to each of the valves 14, 15, 16, and 17 to effect a controlled-temperature mode transfer or maintain operation in the desired full arc or partial arc mode.

Before the structure and operation of mode transfer unit 38 are described in detail, a discussion of certain mode parameters any typical mode transfers is appropriate. For convenience, each mode of operation may be characterized by a particular value of an admission reference factor AR. In the remainder of the discussion an AR of 1.0 is specified for the full arc mode and an AR of 0 for the partial arc mode. Thus an AR of 0.5 represents an operating mode halfway between full arc and partial arc operation.

Figure 2:
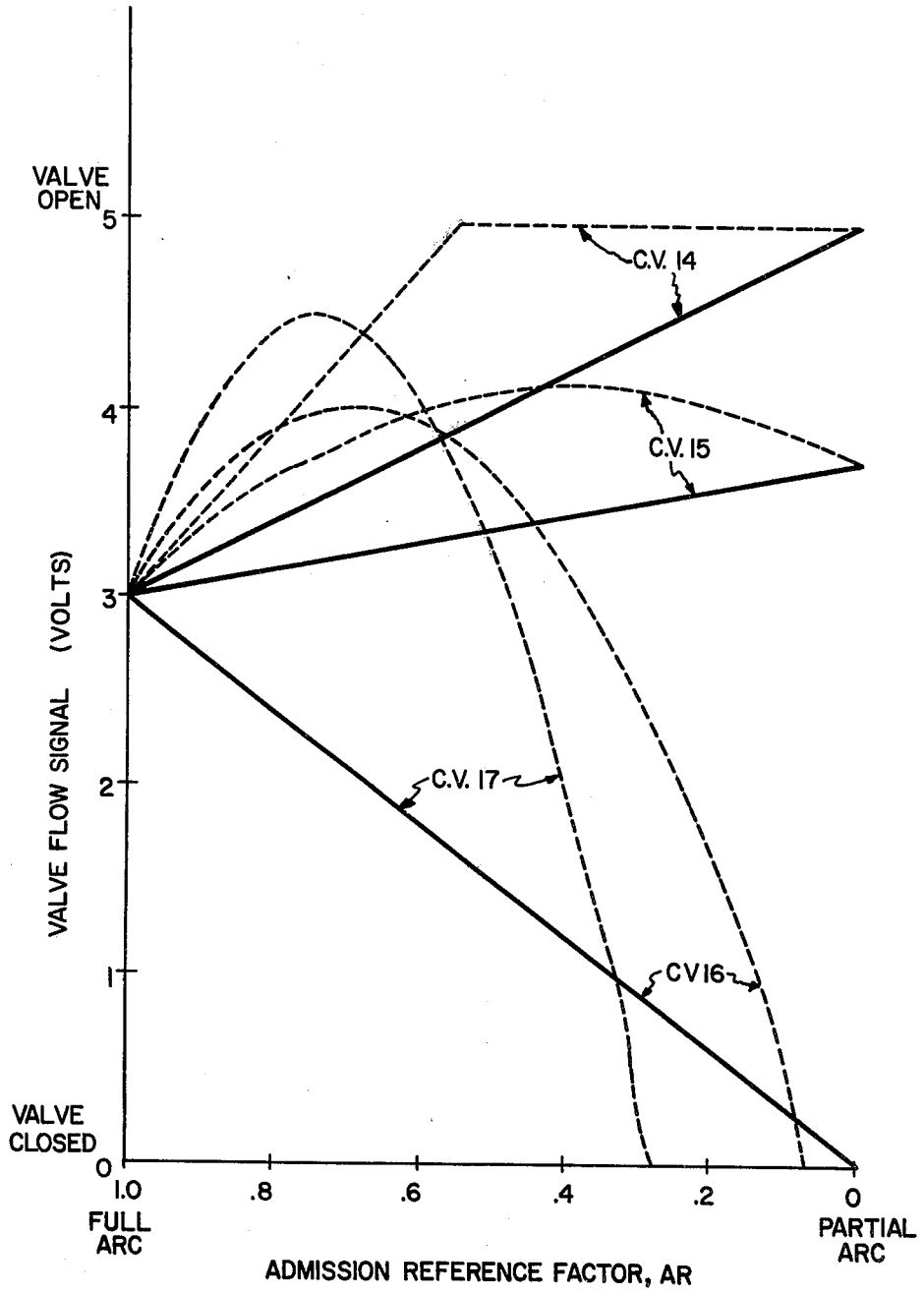
FIG. 2 is a graph showing the variation of mode signals for a set of four valves during a transfer from the full arc mode to the partial arc mode according to a prior art transfer system and the variation according to a preferred embodiment of the present invention.
Figure 3:
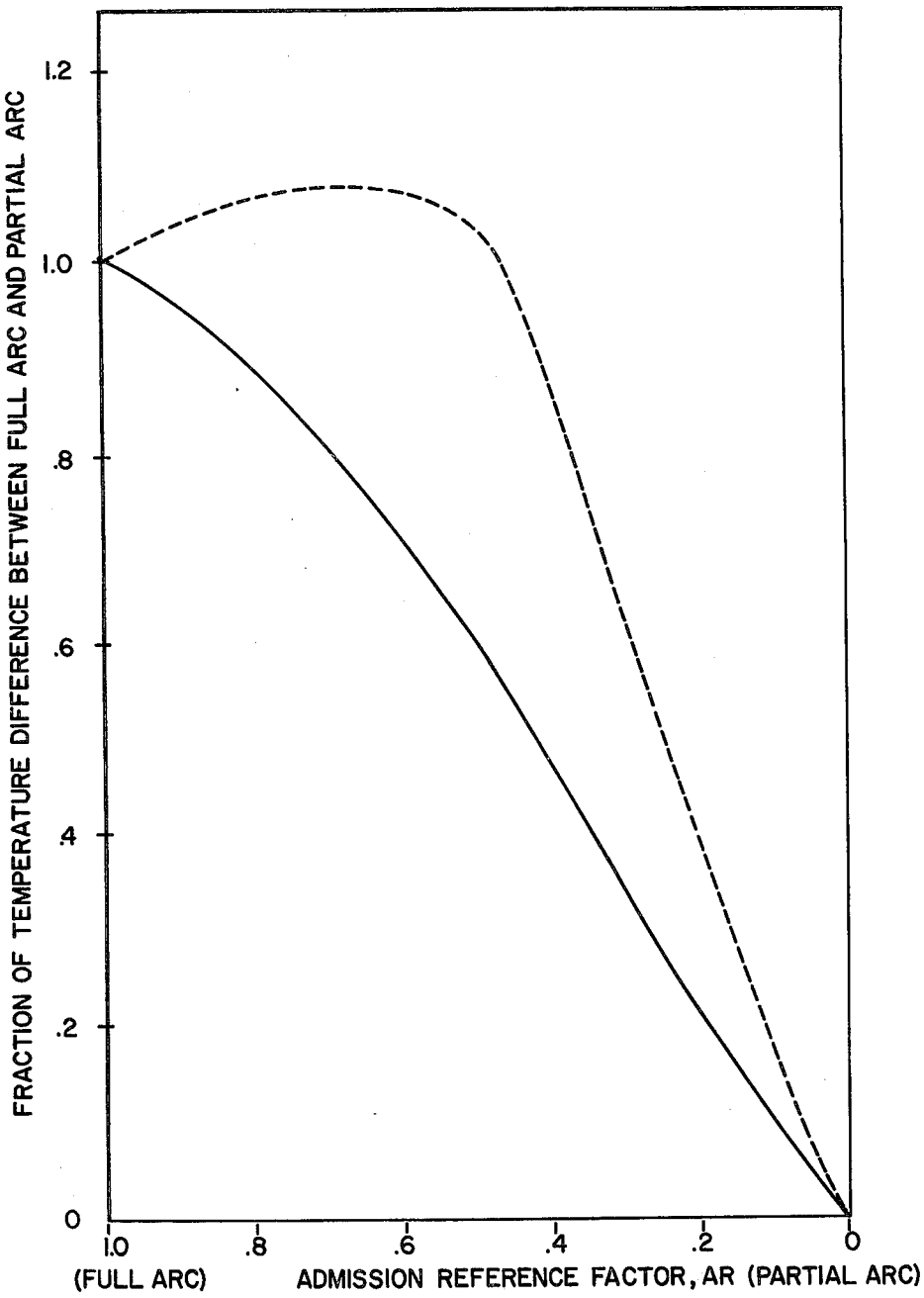
FIG. 3 is a graph showing the variation in temperature of the first stage of the turbine during a full arc to partial arc transfer both according to a prior art system and according to the principles of a preferred embodiment of the present invention.

FIGS. 2 and 3 illustrate mode transfers between full arc and partial arc operation at part load according to both a typical prior art transfer system using variable biases and gains (dashed curves) and according to a preferred embodiment of the present invention (solid curves). FIG. 2, a plot of valve flow signal versus admission reference factor for a steam turbine with four control valves such as valves 14, 15, 16, and 17 of FIG. 1, indicates that during the prior art transfer, valves 16 and 17 initially are misdirected towards a more open position (higher flow signal) than their no-flow or fully closed partial arc position and that total flow does not remain constant but increases somewhat during at least the initial portion of the transfer (note the initial upward trend of all dashed curves). Moreover, valves 14, 15, 16, and 17 reach their partial arc values of flow signal at different values of AR, with valve 14 in particular attaining its partial arc signal at an AR of about 0.55, less than halfway through the transfer as measured by admission reference factor. The implications of this valve flow signal pattern are shown in the dashed curve in FIG. 3, a plot of first stage high-pressure turbine casing temperature change during a mode transfer, which indicates that essentially the whole change in first stage turbine temperature which accompanies the full arc to partial arc transfer occurs between AR=0.55 and AR=0. Since turbine stress is a function of the rate of change of temperature, and a typical mode transfer may be effected within a specified time interval, the prior art transfer using variable biases and gains may yield undesirably high stresses. These rapid temperature changes and high stresses occur even if conventional means such as a pressure feedback loop (not shown) from high-pressure turbine 22 (FIG. 1) to load control unit 36 are employed to assure constant total flow during the transfer. Moreover, the dashed curves of FIGS. 2 and 3 would assume a considerably different pattern for a transfer at a different part load condition, reflecting valve flow and turbine temperature profiles which cannot be readily predicted or controlled for the different mode transfers required during steam turbine operation. As a result, excessive or even cyclic turbine stresses may develop during prior art mode transfers.

The solid curves of FIGS. 2 and 3, which illustrate a transfer from the full arc mode to the partial arc mode according to a preferred embodiment of the present invention, indicate that when the flow signal for each valve is caused to vary linearly with admission reference factor from its full arc value to its partial arc value (FIG. 2), thus holding total steam flow constant, then (FIG. 3) the temperature varies approximately linearly with AR during the transfer. The linear temperature variation, which is independent of the part load condition at which the transfer is effected, permits determination and thus control of the rate of change of first stage turbine temperature through appropriate control of admission reference factor. This in turn permits management of turbine stresses and, if admission reference factor is properly coordinated with other stress monitoring devices and with load control unit 36, allows faster turbine loading and unloading at lower stresses.

To achieve the desired linear changes in flow signal with admission reference factor, the electrohydraulic control system 13 includes mode transfer unit 38, which in the preferred embodiment of the invention shown in FIG. 1 comprises individual flow signal generators 46, 47, 48 and 49 and control valve positioning units 50, 51, 52, and 53 for each of control valves 14, 15, 16, and 17; a time ratio circuit 55; and an admission reference unit 56.

Figure 4:
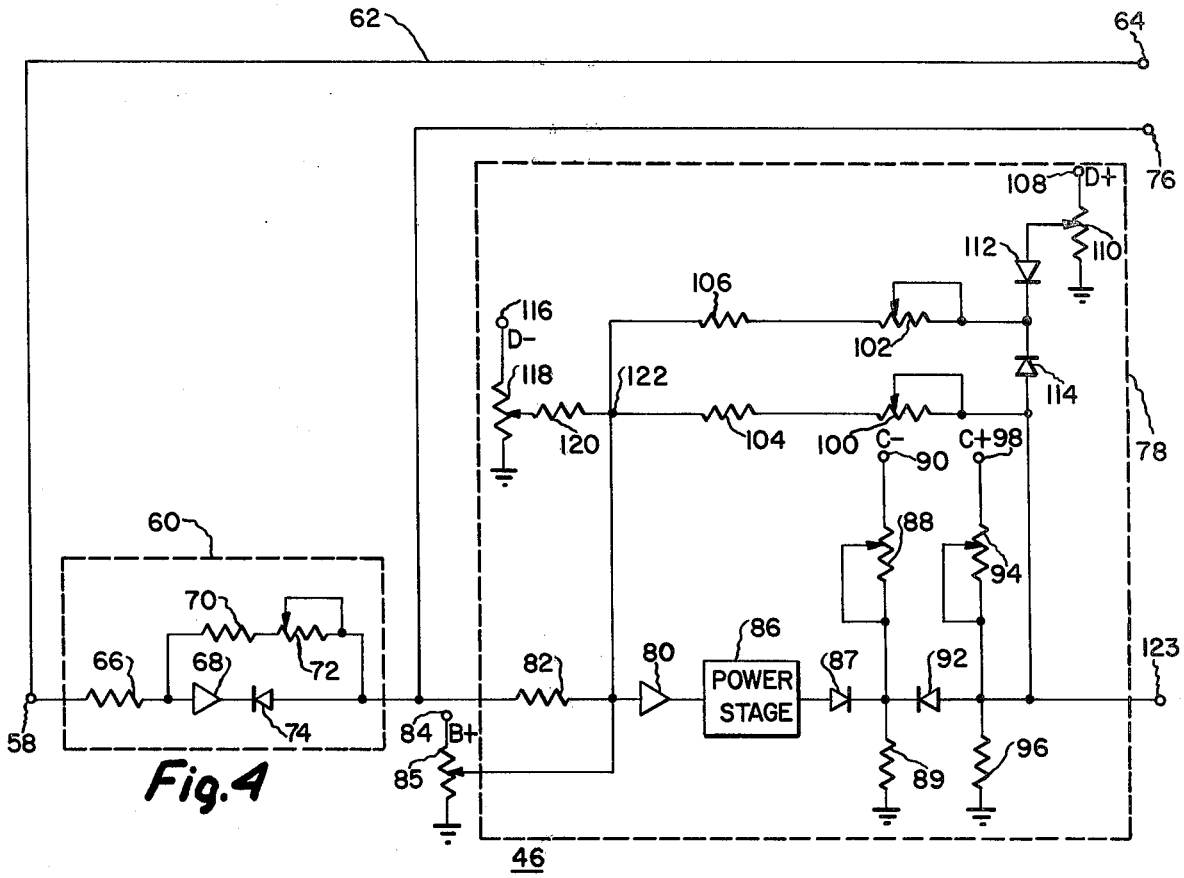
FIG. 4 is a circuit diagram of a flow signal generator suitable for use with a control valve in a controlled-temperature mode transfer.
Figure 5:
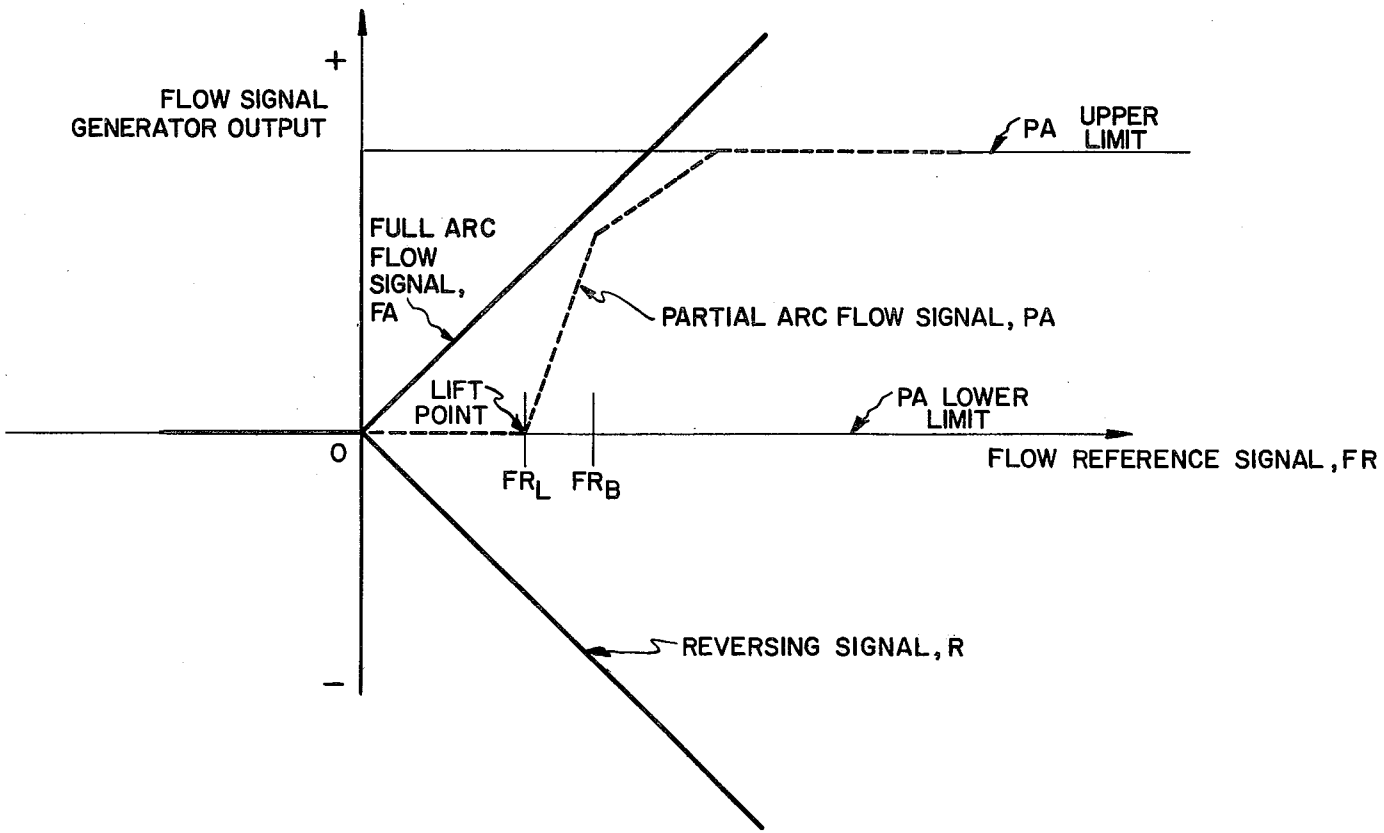
FIG. 5 is a graph showing, in accordance with a preferred embodiment of the invention, plots of output signals produced by a flow signal generator in response to a flow reference signal.

A typical flow signal generator of the mode transfer unit 38, for example flow signal generator 46, is shown in FIG. 4. Flow signal generator 46 receives a flow reference signal from load control unit 36, which signal is also directed to flow signal generators 47, 48, and 49, and in response, signal generator 46 provides a full arc signal, a reversing signal, and a partial arc flow signal to control valve positioning unit 50. A plot of these output signals as a function of flow reference signal FR is shown in FIG. 5.

Flow signal generator 46 receives the flow reference signal at input terminal 58 and transmits it to reversing signal network 60 and by line 62 to output terminal 64 to serve as the full arc flow signal FA. After passing through input resistor 66 of reversing signal network 60, the flow reference signal is multiplied by −1 by amplifier 68, the gain magnitude of 1.0 assured by proper selection of resistors 79 and 66 and by adjustment of trim potentiometer 72. Diode 74 provides a zero limit so that the reversing signal R transmitted to output terminal 76 and plotted against flow reference signal in FIG. 5 is zero for negative values of the flow reference signal FR and equal to −FR for positive values of FR (negative values of FR are associated with closed end overtravel of the control valves).

Flow signal generator 46 also includes partial arc amplifier network 78 for producing a partial arc flow signal in response to the reversing signal fed into amplifier 80 through resistor 82. Also input to amplifier 80 is a valve closing bias signal B+ applied at terminal 84 and adjustable by means of potentiometer 85, the bias signal acting to establish the lift point of control valve 14 (the flow reference signal $FR_L$ at which valve 14 begins to open) as indicated in the plot of partial arc flow signal PA versus flow reference signal in FIG. 5 for a preferred embodiment of the invention. The dual-slope piecewise linear nature of the partial arc flow signal characteristic shown permits added flexibility and accuracy in maintaining constant steam flow and turbine speed during a mode transer, thus permitting accurate control of first stage temperature.

Amplifier 80 of partial arc amplifier 78 combines the reversing signal and valve closing bias signal and, together with power stage 86, which may be a transistor, amplifies the resultant signal to produce a partial arc flow signal. To restrict the partial arc flow signal to values within the range of operation of control valve 14, diode 87, trim potentiometer 88, and resistor 88 are provided, which, in cooperation with an appropriate negative potential C− applied at terminal 90, establish a lower limit to the partial arc flow signal. An upper limit is set by diode 92, trim potentiometer 94, and resistor 96 operating in conjunction with positive potential C+ applied at terminal 98.

Gain adjustments for the partial arc flow signal of FIG. 5 are provided in a dual feedback loop including trim potentiometers 100 and 102 and resistors 104 and 106. For values of flow reference signal greater than $FR_L$, i.e., the point at which valve 14 begins to open, but less than $FR_B$, the point at which the slope of the partial arc flow signal characteristic changes, a positive bias signal D+ applied at terminal 108 and passed through potentiometer 110 and diode 112 prevents diode 114 from conducting, and gain adjustment for the partial arc flow signal is therefore provided by trim potentiometer 100. (In this regime, negative bias signal D− applied at terminal 116 and modified by potentiometer 118 and resistor 120 cancels the contribution of positive bias signal D+ at point 122.) For values of flow reference signal greater than $FB_B$, diode 114 conducts and gain adjustment is provided by both potentiometers 100 and 102.

Thus the partial arc flow signal at terminal 123 is zero for values of flow demand signal less than $FR_L$, at which point the associated control valve 14 begins to open, then linear with flow reference signal up to the control valve full flow condition according to a dual-slope relationship determined from flow characteristics of valve 14 (i.e., plots of its full arc and partial arc flow versus total steam flow).

Figure 6:
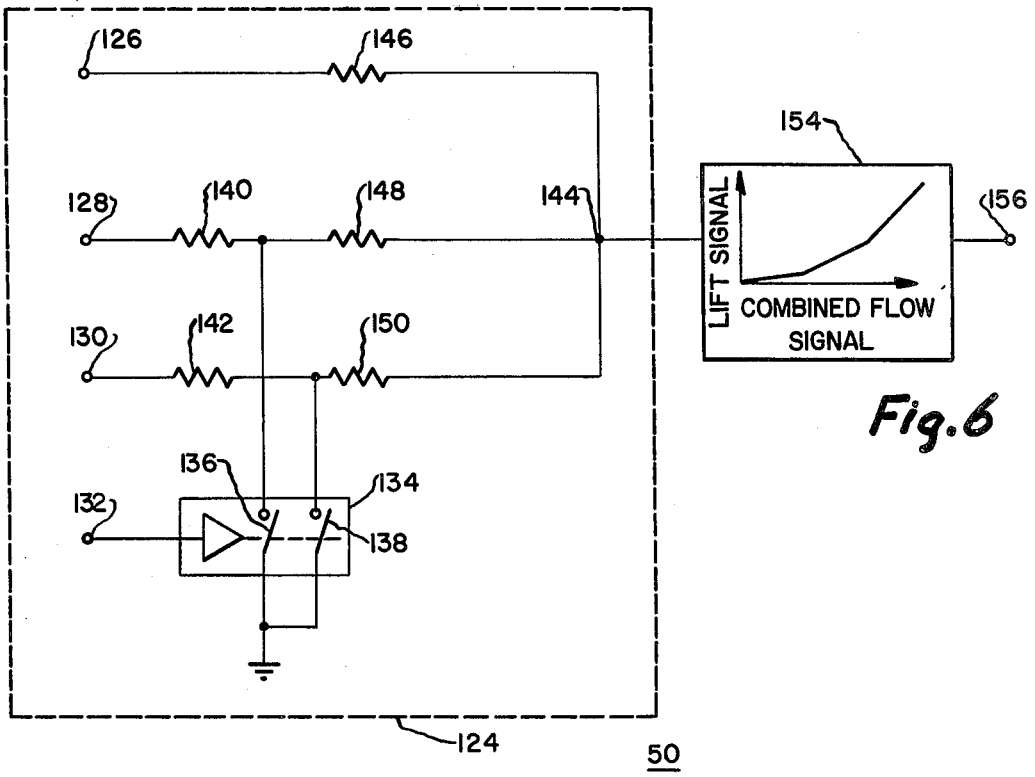
FIG. 6 is a circuit diagram of a control valve positioning unit suitable for use with a control valve in a controlled-temperature mode transfer.

FIG. 6 shows a typical control valve positioning unit (CVPU) 50, which includes signal conditioner 124 having terminals 126, 128, and 130 to receive, respectively, the full arc flow signal, reversing signal, and partial arc flow signal from flow signal generator 46, it being understood that similar positioning units are also provided for each of control valves 15, 16, and 17. Also applied to signal conditioner 124 at terminal 132 is a time ratio signal from time ratio circuit 55. The time ratio signal is an electronic multiplier generated in time ratio circuit 55 in response to a signal from admission reference unit 56. In a preferred embodiment, time ratio circuit 55 comprises a pulse generator for producing a series of pulses of progressively varying cycle width or duty cycle as disclosed in the above-cited U.S. Pat. No. 3,740,588 to Stratton et al. However, other means of electronic multiplication may be used.

Signal conditioner 124 includes a two-pole switching device 134 having switches 136 and 138. For full arc operation the admission reference factor AR is set at 1.0 and the time ratio signal input to switching device 134 consists of a pulse of 100 percent duty cycle. Switches 136 and 138 close and remain closed, shunting the reversing signal and partial arc flow signal to ground through resistors 140 and 142, respectively. The combined flow signal at summing junction 144 therefore comprises the full arc flow signal from terminal 126 as modified by an appropriate impedance device such as resistor 146. For partial arc operation the admission reference factor AR is set at zero, no pulses (i.e., pulses of zero width) are included in the time ratio signal input to switching device 134, and switches 136 and 138 open and remain open, thus passing to junction 144, in addition to the full arc flow signal through resistor 146, a conditioned signal equal to the reversing signal and partial arc flow signal as proportionately summed by resistors 140, 148, 142, and 150. Since the reversing signal is equal to $-FA$ for all positive values of the full arc flow signal FA, the combined flow signal at terminal 144 for an AR of 0.0 and appropriate choice of resistances is the partial arc flow signal as modified by resistors 142 and 150.

At values of admission reference factor between 1.0 and 0, i.e., during a mode transfer (and in the remaining discussion ignoring for simplicity the signal modifications imposed by the resistors of signal conditioner 124), the contribution to the combined flow signal at 144 of the reversing signal R and the partial arc flow signal PA will equal $(R+PA)(1-AR)$. Thus, for positive values of the full arc flow signal, where $R=-FA$, the combined flow signal is $PA(1-AR)+FA(AR)$.

In addition to providing means for calculating a combined flow signal at junction 144, control valve positioning unit 50 also includes a lift signal generator 154 which corrects the combined flow signal for the typically non-linear relationship between valve flow and valve lift and provides an electrical valve lift signal at terminal 156. As is known, and described for example in U.S. Pat. No. 3,403,892 to Eggenberger et al discussed above, the electrical valve lift signal may readily be transferred to an actual lift or position of valve 14 by means (not shown) within control valve positioning unit 50 such as hydraulic fluid operating in conjunction with a pilot valve, the hydraulic fluid in turn operating a piston connected to a movable disk of control valve 14.

Since the use of separate lift signal functions for both the partial arc mode and the full arc mode would result in a very complex control system, in a preferred embodiment of the invention as illustrated in lift signal generator 154 of FIG. 6, a single curve constructed as a piecewise three-slope linear approximation to the flow-lift characteristic of each control valve operating in the full arc mode is used in each lift signal generator such as 154 for generating electrical valve lift signals for both modes. Use of the single curve constructed from a full arc flow-lift characteristic for both full arc operation and, with suitable rescaling provided by the partial arc amplifier network 78 of flow signal generator 46, for partial arc and intermediate mode operation, not only permits a less complex control system than would a dual set of functions, but also allows flow to be held more nearly constant during a mode transfer than would use of a single curve constructed from a partial arc flow-lift characteristic. Improved flow accuracy in turn permits better control of first stage temperature and turbine stresses.

Operation of the control system 13 may be illustrated by the following description of a mode transfer from the full arc mode of operation to the partial mode, it being understood that mode transfers from partial arc to full arc and from one intermediate mode to another may also be readily accomplished. At initiation of the transfer, control valves 14, 15, 16, and 17 are operating in the full arc mode, each admitting a portion of the total steam flow to the turbine inlet. Thus the admission reference factor AR in admission reference unit 56 is 1.0, and the admission reference signal input to time ratio circuit 55 is generating a multiplier which in signal conditioner 124 multiplies the reversing signal and partial arc flow signal by zero, producing a combined flow signal at 144 equal to the full arc signal and thus a full arc valve lift signal from lift signal generator 154. To effect the transfer to the partial arc mode, AR is varied from 1.0 to 0 at a suitable rate in admission reference unit 56. It should be noted that AR and therefore the admission reference signal can be varied at different rates in unit 56 by, for example, a manually operated or motor-driven potentiometer (not shown) or, alternatively, admission reference unit 56 could be connected to a suitable stress control unit and the admission reference factor varied to maintain or minimize turbine stress levels.

The controlled decrease of AR from 1.0 to 0 progressively decreases the pulse width of the time ratio signal input to signal conditioner 124, increasing the multiplier applied to the partial arc flow signal and reversing signal until at $AR=0.0$ a multiplier of 1.0 is achieved. The combined flow signal at point 144 is then equal to the partial arc flow signal, and the lift signal generator 154 produces a valve lift signal for partial arc mode operation. During the mode transfer the combined flow signal for each of control valves 14, 15, 16, and 17 at terminal 144 varies linearly with admission reference factor from the full arc mode signal to the partial arc flow signal as illustrated by the solid lines of FIG. 2. This maintains turbine steam flow constant during the transfer and results in a substantially linear variation of first stage turbine casing temperature with admission reference factor AR. Since the rate of change of AR is controlled, temperature changes, and therefore stress levels, are also controlled during the mode transfer.

While there has been shown and described what is considered a preferred embodiment of the invention, it is understood that various other modifications may be made therein. For example, a different number of slopes may be utilized to generate the partial arc flow signal function illustrated in FIG. 5 or the lift signal function shown in FIG. 6. It is intended to claim all such modifications which fall within the true spirit and scope of the present invention.

What is claimed is:

1. In combination with a control system for a steam turbine having a plurality of valves arranged about nozzle arcs for admitting steam in a full arc mode and in a partial arc mode as determined by an admission reference factor AR and wherein said control system includes a flow reference signal indicative of turbine load, the improvement comprising a controller for transferring between modes so that steam flow remains substantially constant during transfer and temperature of a predetermined portion of the turbine varies substantially linearly with admission reference factor as it is varied between modes, said controller comprising:

means for generating said admission reference factor AR and for varying said factor during a mode transfer;

time ratio means for generating a multiplier (1−AR) in responsive to said admission reference factor;

a plurality of flow signal generators, there being one flow signal generator per valve, each said flow signal generator producing a full arc mode signal FA, a partial arc mode signal PA, and a reversing signal R, each said signal being a preselected function of said flow reference signal;

a plurality of signal conditioners for producing a plurality of combined flow signals according to the signal relationship FA+(R+PA) (1−AR), there being one signal conditioner and one combined flow signal per valve; and, a plurality of lift signal generators for producing valve lift signals in response to said combined flow signals, there being one lift signal generator per valve.

2. The combination of claim 1 wherein said time ratio means comprises a pulse generator for producing a series of pulses whose width is selectively variable between zero and one hundred percent duty cycle corresponding to variation in said multiplier (1−AR) of one to zero.

3. The combination of claim 1 wherein each said flow signal generator includes a partial arc amplifier network for producing said partial arc mode signals according to a dual-slope piecewise linear function of said flow reference signal.

4. The combination of claim 3 wherein each flow signal generator includes adjustable bias means for selecting the magnitude of flow reference signal at which each valve begins to open in said partial arc mode so that said valves operate sequentially as a function of said flow reference signal during said partial arc mode.

5. The combination of claim 1 wherein each said lift signal generator provides a correction factor to each said combined flow signal to correct for non-linear flow characteristics of each valve so that a linear change in each combined flow signal produces a linear response in steam flow through each valve.

6. A method of transferring operation of a plurality of valves arranged about nozzle arcs of a steam turbine between a full arc steam admission mode of operation and a partial arc admission mode of operation so that total steam flow remains substantially constant and temperature of the first stage turbine casing varies in a controlled manner during transfer, comprising the steps of:

(a) generating an admission reference factor whose value characterizes the operating mode;

(b) producing a multiplier whose value is a function of said admission reference factor;

(c) providing a flow reference signal indicative of turbine loading; and, comprising for each valve the steps of:

(d) producing a full arc signal, a partial arc signal, and a reversing signal, each a preselected function of said flow reference signal;

(e) applying said multiplier to said partial arc signal and said reversing signal to form a conditioned signal;

(f) generating a combined flow signal which is the sum of said conditioned signal and said full arc signal;

(g) applying a correction factor to said combined flow signal, producing thereby a valve lift signal so that steam flow through each valve changes linearly with said combined flow signal; and, (h) varying said admission reference factor between its full arc mode value and its partial arc mode value so that a mode transfer is effected.

* * * * *